US012428951B2

(12) United States Patent
Anazi et al.

(10) Patent No.: US 12,428,951 B2
(45) Date of Patent: Sep. 30, 2025

(54) ANNULUS MONITORING AUTONOMOUS NETWORK

(71) Applicant: Saudi Arabian Oil Company, Dhahran (SA)

(72) Inventors: Ammal Anazi, Dammam (SA); Mohannad Gizany, Dammam (SA); Abdulaziz Murad, Jeddah (SA); Saleh Alhumaid, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 197 days.

(21) Appl. No.: 18/326,604

(22) Filed: May 31, 2023

(65) Prior Publication Data

US 2024/0401468 A1 Dec. 5, 2024

(51) Int. Cl.
*E21B 47/06* (2012.01)
*E21B 33/03* (2006.01)
*E21B 41/00* (2006.01)

(52) U.S. Cl.
CPC ..... *E21B 47/06* (2013.01); *E21B 33/03* (2013.01); *E21B 41/00* (2013.01)

(58) Field of Classification Search
CPC ..... E21B 33/03; E21B 41/00; E21B 47/06
See application file for complete search history.

(56) References Cited

U.S. PATENT DOCUMENTS 5,103,900 A * 4/1992 McLeod ..... E21B 33/04 166/88.1
9,494,710 B2 * 11/2016 Gonzales ..... E21B 47/00
10,113,410 B2 * 10/2018 Stephens ..... E21B 47/001
2010/0252271 A1 * 10/2010 Kelley ..... E21B 43/14 166/370
2013/0173168 A1 * 7/2013 Abitrabi ..... E21B 43/32 702/6
2013/0245949 A1 * 9/2013 Abitrabi ..... G01V 13/00 702/6
2013/0253837 A1 * 9/2013 Abitrabi ..... G01V 9/005 702/6
2020/0095861 A1 3/2020 Camilleri
(Continued)

FOREIGN PATENT DOCUMENTS

WO WO-2014039512 A1 * 3/2014 ..... G05B 23/0297

OTHER PUBLICATIONS

Alghamdi, "Oil Wells Corrosion Prediction by GC Fingerprinting of Casings Fluids," Paper 11430, NACE International Corrosion Conference and Expo 2018, 9 pages.
(Continued)

*Primary Examiner* — Daniel P Stephenson
(74) *Attorney, Agent, or Firm* — Fish & Richardson P.C.

(57) ABSTRACT

Methods and systems for autonomously detecting and categorizing well integrity issues in hydrocarbon production wells (e.g., gas and oil wells), water injection wells, and water disposal wells. A method involves obtaining a wellhead pressure and a tubing-casing annulus (TCA) pressure of a wellbore; calculating a difference between the wellhead pressure and the TCA pressure; determining whether the difference is less than or equal to a predetermined threshold; and determining, based on whether the difference is less than or equal to the predetermined threshold, whether at least one wellbore integrity issue has occurred.

14 Claims, 6 Drawing Sheets

(56) References Cited

U.S. PATENT DOCUMENTS

| | | | | |
|---|---|---|---|---|
| 2021/0332652 | A1 | 10/2021 | Muraikhi | |
| 2023/0080453 | A1* | 3/2023 | Idris | E21B 47/06 166/250.01 |
| 2023/0228184 | A1* | 7/2023 | Al-Dhafeeri | E21B 47/008 166/250.15 |
| 2024/0401468 | A1* | 12/2024 | Anazi | E21B 41/00 |

OTHER PUBLICATIONS

Elyas et al., "Well Integrity Catastrophe Avoided Through Advanced Well Integrity and Reservoir Monitoring Analysis, a Case Study," SPE-208055-MS, Abu Dhabi International Petroleum Exhibition & Conference held in Abu Dhabi, UAE, Nov. 15-18, 2021, published on Dec. 9, 2021, 12 pages.

Morshidi et al., "An Evaluation of Production Casing Corrosion Due to Ingress of Sour Gas in the Tubing-Casing Annulus," IPTC 17423, IPTC, International Petroleum Technology Conference in Doha, Qatar, Jan. 20-22, 2014, 10 pages.

Posdyshev et al., "Using DNA-Logging to Determine Inflow Profile in Horizontal Wells," SPE-206515-MS, SPE Russian Petroleum Technology Conference held on Oct. 12-15, 2021, 11 pages.

Ragab et al., "Application of Machine Learning Algorithms for Managing Well Integrity in Gas Lift Wells," SPE-205736-MS, SPE/IATMI Asia Pacific Oil & Gas Conference and Exhibition held on Oct. 12-14, 2021, published on Oct. 4, 2021, 26 pages.

Zakir et al., "Success Cases for Temperature Survey in Detection Communication between Tubing Annulus and Integrity Check for Through Tubing Bridge Plug also Cross Flow Determination and Evaluation for Continuous Gas Lift System by Simply Way of Temperature & Pressure Gauges in Gulf of Suez Fields—Egypt," SPE-197924-MS, Abu Dhabi International Petroleum Exhibition & Conference held in Abu Dhabi, UAE, Nov. 11-14, 2019, 17 pages.

* cited by examiner

ANNULUS MONITORING AUTONOMOUS NETWORK

TECHNICAL FIELD

This description relates to an annulus monitoring autonomous network.

BACKGROUND

In the hydrocarbon production industry, well integrity is an important issue to be monitored and maintained. Examples of well integrity issues include borehole rock instability issues, cased hole leaking, tubing failures and leaks, downhole packer failures, split casing issues, and deteriorated casing section issues.

SUMMARY

This disclosure describes systems and methods for autonomously detecting and categorizing well integrity issues in hydrocarbon production wells (e.g., gas and oil wells), water injection wells, and water disposal wells. Additionally, the systems and methods can perform mitigating or remedial actions in response to detecting the well integrity issues. The disclosed systems integrate several subsystems and processes information from these subsystems to risk-rank and preemptively detect tubing leaks, casing leaks, wellhead communication, and packer failures in a more efficient manner than existing methods.

One aspect of the subject matter described in this specification may be embodied in a method that involves obtaining a wellhead pressure and a tubing-casing annulus (TCA) pressure of a wellbore; calculating a difference between the wellhead pressure and the TCA pressure; determining whether the difference is less than or equal to a predetermined threshold; and determining, based on whether the difference is less than or equal to the predetermined threshold, whether at least one wellbore integrity issue has occurred.

The previously described implementation is implementable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In some implementations, determining, based on whether the difference is less than or equal to the predetermined threshold, whether the at least one wellbore has occurred involves: determining that the difference is greater than the predetermined threshold; and in response, determining that the wellbore integrity issue has not occurred.

In some implementations, the method further involves after a predetermined time, obtaining new values of the wellhead pressure and the TCA pressure.

In some implementations, determining, based on whether the difference is less than or equal to the predetermined threshold, whether the at least one wellbore has occurred involves: determining that the difference is less than or equal to the predetermined threshold; and in response, determining that the at least one wellbore integrity issue has occurred.

In some implementations, the method further involves in response determining that the at least one wellbore integrity issue has occurred, performing a remedial action to mitigate the at least one wellbore integrity issue.

In some implementations, the remedial action includes at least one of: shutting in the wellbore; generating an instruction for a computing device to output a notification informing a production engineer of the at least one wellbore integrity issue; scheduling a field service crew to pack-off the wellbore; or scheduling a wellhead replacement for the wellbore.

In some implementations, the predetermined threshold is based on one or more of: deviation of the wellbore, a type of fluid in the TCA, a gas-oil-ratio for a field of the wellbore, the presence of artificial lift mechanisms, a flow regime in the wellbore, a temperature profile throughout the wellbore, or surface level weather conditions.

In some implementations, the predetermined threshold is one third of an average of the wellhead pressure.

In some implementations, the wellbore is a water supply wellbore, a gas injection wellbore, a water injection wellbore, or an oil and gas production wellbore.

In some implementations, the wellhead pressure includes a pressure measured at a point between a choke and a wing valve of the wellbore.

In some implementations, the TCA pressure includes a pressure measured at a port between a tubing and a casing of the wellbore.

The details of one or more embodiments of these systems and methods are set forth in the accompanying drawings and description below. Other features, objects, and advantages of these systems and methods will be apparent from the description, drawings, and claims.

BRIEF DESCRIPTION OF THE DRAWINGS

Like reference numbers and designations in the various drawings indicate like elements.

DETAILED DESCRIPTION

This disclosure describes systems and methods for autonomously detecting and categorizing well integrity issues in hydrocarbon production wells (e.g., gas and oil wells), water injection wells, and water disposal wells. Additionally, the systems and methods can perform mitigating or remedial actions in response to detecting the well integrity issues. The disclosed systems integrate several subsystems and processes information from these subsystems to risk-rank and preemptively detect tubing leaks, casing leaks, wellhead communication, and packer failures in a more efficient manner than existing methods.

Figure 1:
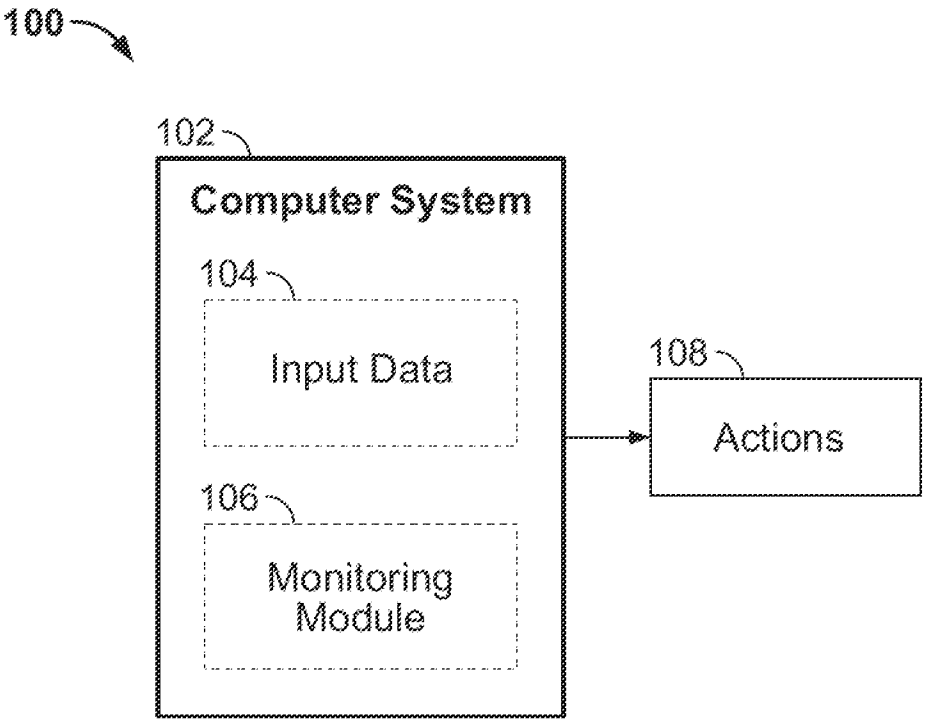
FIG. 1 illustrates a block diagram of an example annulus monitoring autonomous network, according to some implementations.

FIG. 1 illustrates a block diagram of an example annulus monitoring autonomous network (AMAN) 100, according to some implementations. The AMAN 100 can be used for monitoring a wellbore. As shown in FIG. 1, the AMAN 100 includes a remote terminal unit (RTU) 102. The RTU 102 can include input data 104 and monitoring module 106. The monitoring module 106 is configured to monitor a wellbore to detect wellbore integrity issues, e.g., borehole rock instability issues, cased hole leaking or split casing issues, and deteriorated casing section issues. Additionally, the monitoring module 106 is configured to determine, based on the detected well integrity issues, one or more actions 108 for addressing the detected well integrity issues.

Figure 6:
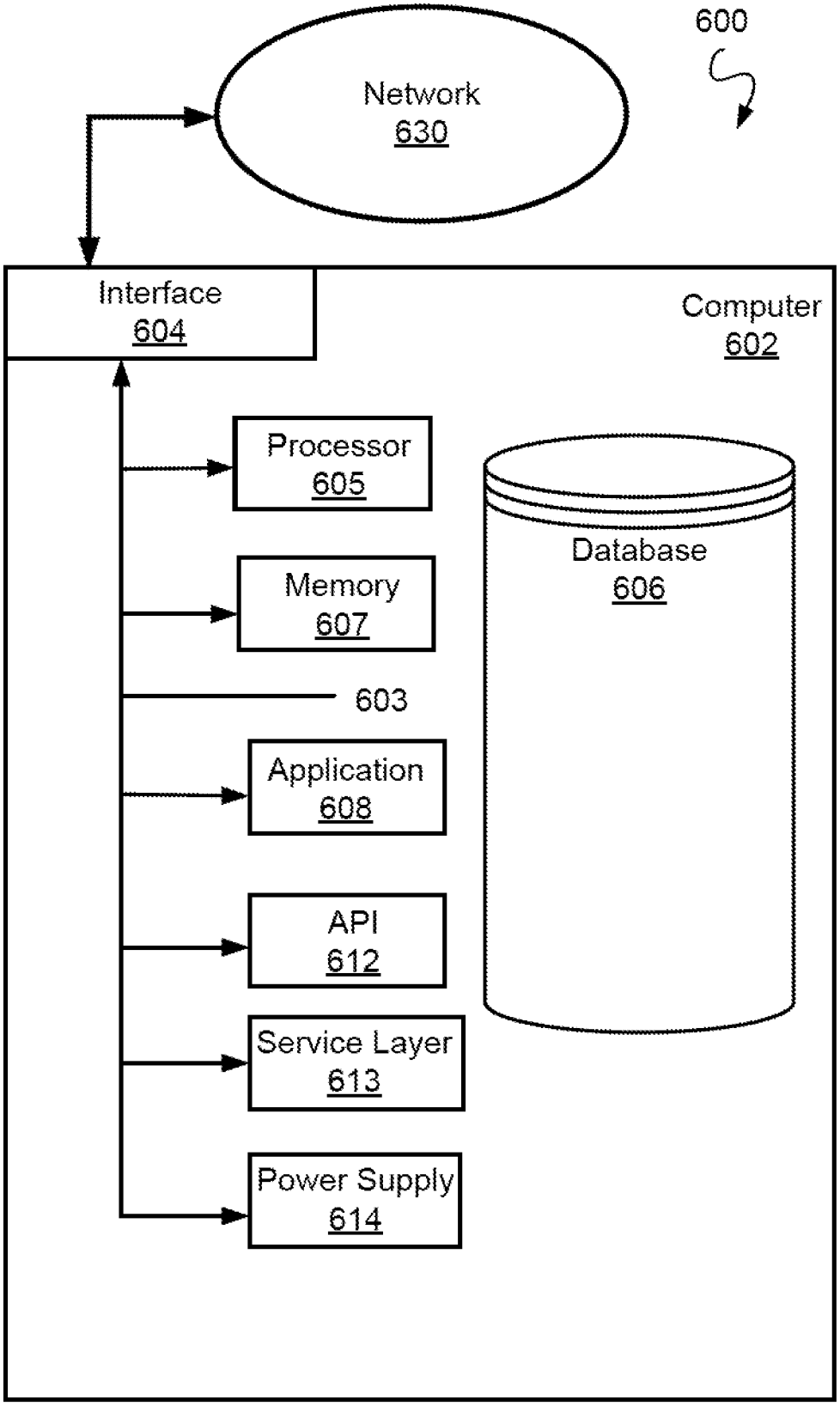
FIG. 6 is a block diagram of an example computer system, according to some implementations.

In some implementations, the RTU 102 can be implemented using a computer system, such as the computer system 600 of FIG. 6. Note that the AMAN 100 is shown for illustration purposes only, as the AMAN 100 can include additional components or have one or more components removed without departing from the scope of the disclosure. Further, note that the various components of the AMAN 100 can be arranged or connected in any manner.

Figure 2:
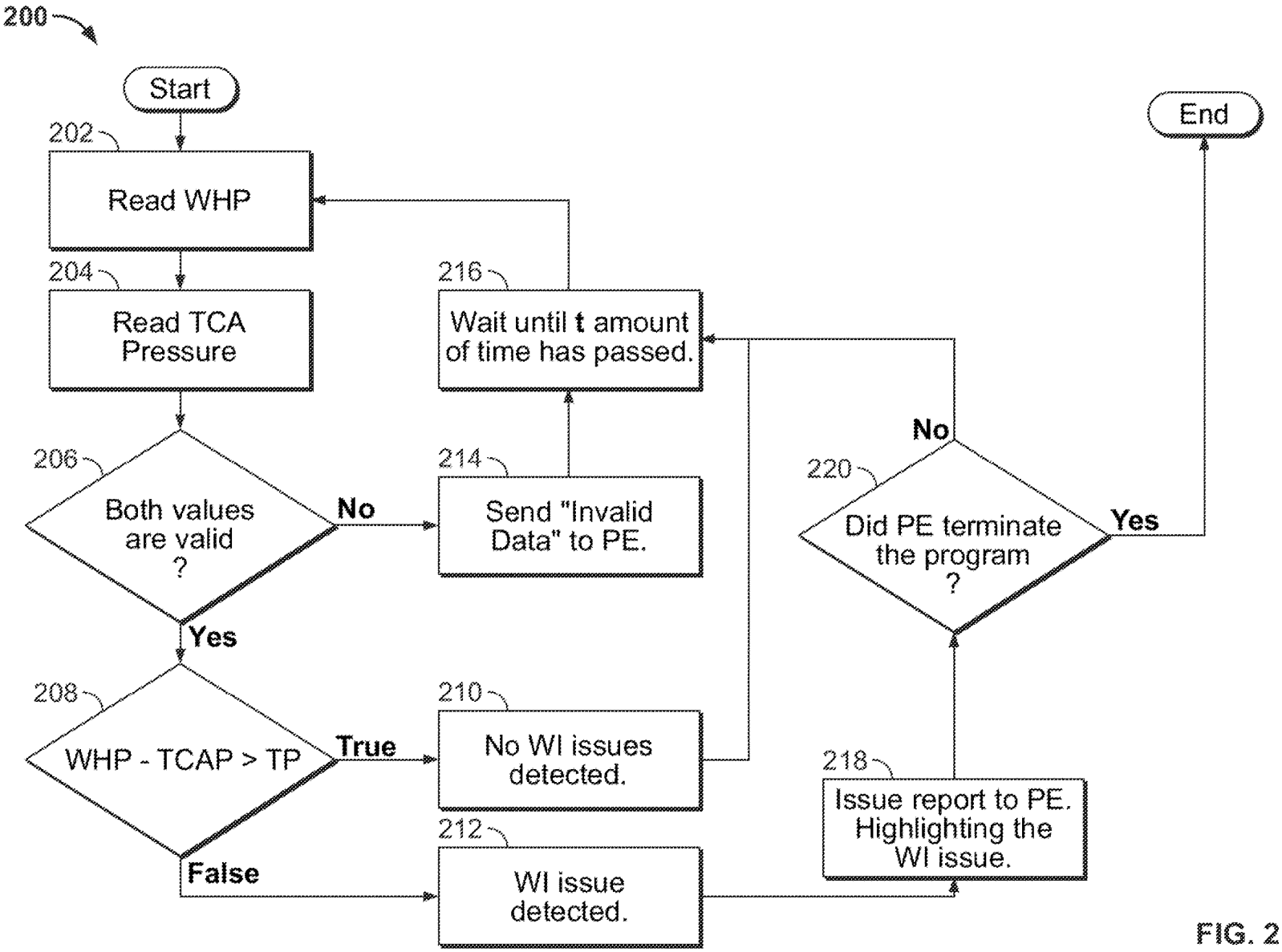
FIG. 2 illustrates an example workflow for wellbore integrity detection, according to some implementations.

FIG. 2 illustrates an example wellbore integrity detection workflow 200, according to some implementations. The workflow 200 can be performed by the RTU 102. In particular, the RTU 102 performs the workflow 200 to monitor a wellbore to detect wellbore integrity issues that may affect the wellbore. The wellbore can be a water supply wellbore, a gas injection wellbore, a water injection wellbore, or an oil and gas production wellbore. The RTU 102 also performs the workflow 200 to determine remedial actions to address the detected issues.

At step 202, the RTU 102 receives direct pressure measurements from a wellhead (WH) sensor of the wellbore. The wellhead sensor measures the pressure at a point between a choke and a wing valve of the wellbore. This pressure is a downstream (D/S) pressure in injection wells an upstream pressure (U/S) in production wells. The pressure represents the pressure that is experienced by a fluid in the wellbore tubing, and can be used to determine the production/injection rate of a well. This pressure is also referred to as wellhead pressure (WHP).

Figure 3:
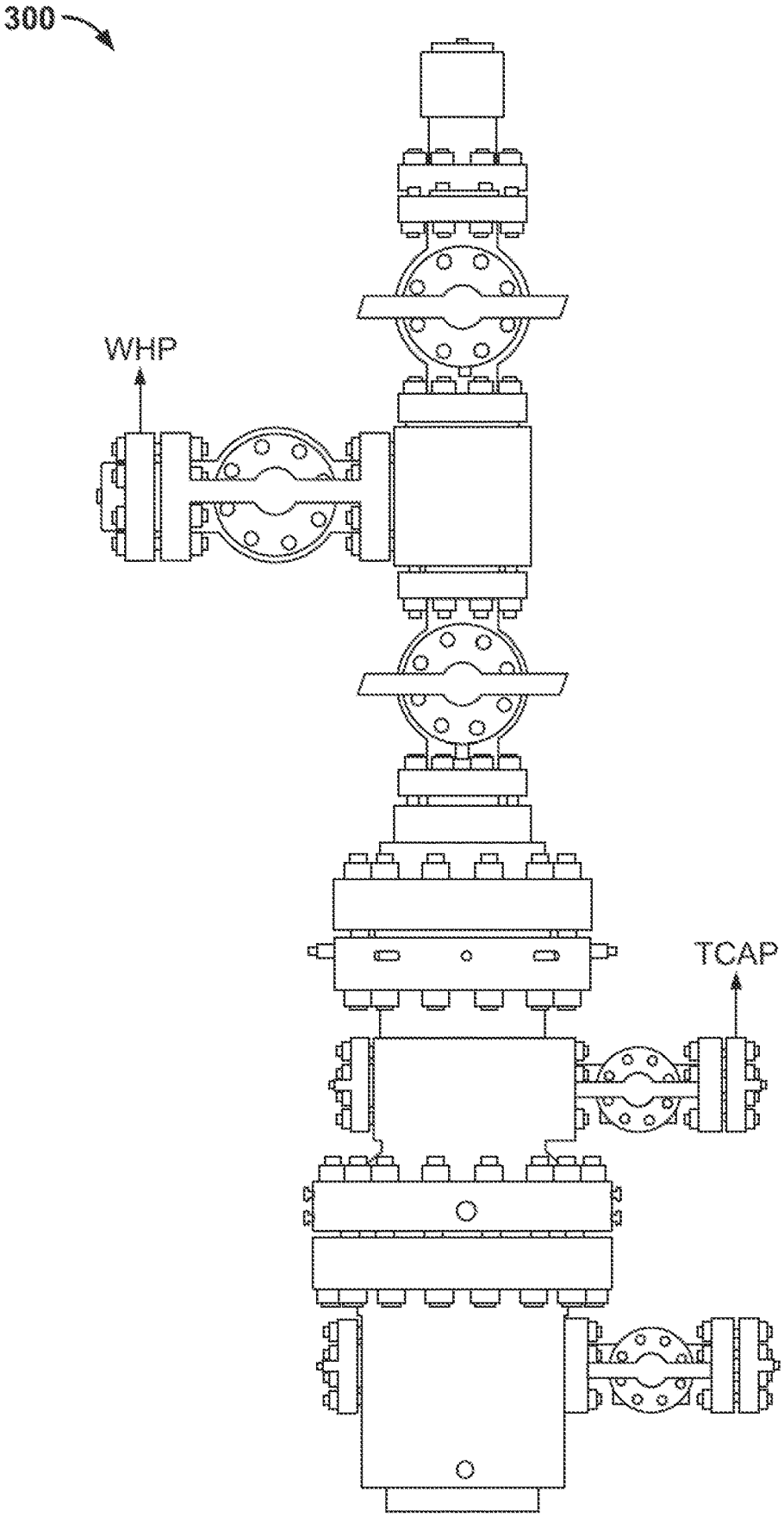
FIG. 3 illustrates an example wellhead of a wellbore, according to some implementations.

At step 204, the RTU 102 receives a tubing-casing annulus (TCA) pressure (TCAP). The TCAP can be measured by a sensor at a port between the tubing and the casing. The pressure represents an accumulated pressure in a volume between the tubing and the inner most casing. This pressure becoming too great can lead to punctures in the tubing, which in turn, can lead to WH-TCA communication. WH-TCA communication refers to the leaks that occur in the rubber seals that separate the pressure in the tubing from the pressure outside the tubing. The seals leaking exposes the pressures in the tubing to the TCAP, or vice versa. An example wellhead is illustrated in FIG. 3.

At step 206, the RTU 102 determines whether both values are valid. If either value is invalid, the RTU 102 moves to step 214. In some examples, the values are invalid if the values are frozen or out of range. Data is considered frozen if the data has been constant for a particular time. e.g., constant to a second decimal point for the last 10 hours. If no fluctuations occur with the specified time period, then the data can be flagged as frozen and discarded since it is not valid. Out of range data refers to values that fall outside of a specified range. For example, it can be specified that wellhead pressure values are only positive. Thus, a negative wellhead pressure value would be considered out of range and discarded. Within examples, the pressure and temperature ranges for the AMAN 100 are set to: (i) Pressure: 0-3000 pound per square inch (psi). (ii) temperature: 50 degrees fahrenheit (F)-450 F. In these examples, values not falling within these ranges (e.g., TCAP=−90 psi or FWHT=5000 F) are automatically discarded and flagged as invalid data.

At step 214, the RTU 102 sends an "invalid data" notification to a responsible production engineer (PE). At step 216, the RTU 102 waits a predetermined period of time, t, before moving back to step 202. The predetermined period of time can be provided by a user or can be based on a frequency of data collection from the wellhead sensors. Note that the predetermined period of time can differ from field to field. One of the limiting factors in determining the predetermined period of time is the communication infrastructure in the fields. In newer fields where fiber optics have a large bandwidth and can transmit numerous data points to our servers, the AMAN 100 can execute as frequently as every second. Thus, how frequently the workflow 200 is executed can be determined based on available infrastructure in the relevant field.

Returning to step 206, if both the WHIP and TCAP values are valid, the RTU 102 moves to step 208. At step 208, the RTU 102 calculates a difference between the WHP and the TCAP. The RTU 102 then determines whether the difference is greater than a predetermined threshold pressure. In some examples, the predetermined threshold is based on deviation of the wellbore, a type of fluid in the TCA, a gas-oil-ratio for a field of the wellbore, the presence of artificial lift mechanisms, a flow regime in the wellbore, a temperature profile throughout the wellbore, and/or surface level weather conditions. This calculation is described in more detail below. In some examples, the RTU 102 calculates the predetermined threshold as one-third of an average of the wellhead pressure (e.g., calculated over a predetermined period of time). In yet other examples, the predetermined threshold is a user provided value, e.g., 200 psi.

In some implementations, if the difference is greater than the predetermined threshold pressure, the RTU 102 moves to step 210. At step 210, the RTU 102 determines that no wellbore integrity issues are detected. The RTU 102 then moves to step 216. As previously described, at step 216 the RTU 102 waits a predetermined period of time, t, before moving back to step 202.

Conversely, if the difference is less than or equal to the predetermined threshold pressure, the RTU 102 moves to step 212. At step 212, the RTU 102 determines that at least one wellbore integrity issue has been detected. Examples of well integrity issues include borehole rock instability issues, cased hole leaking or split casing issues, tubing leaks, casing leaks, and deteriorated casing section issues. Note that detecting a well integrity issue does not necessarily mean that the well integrity issue has occurred. Rather, the well integrity issue can be a potential well integrity issue. After determining that at least one wellbore integrity issue has been detected, the RTU 102 moves to step 218. In some examples, the RTU 102 can identify the type of well integrity issue based on the value of the WHP-TCAP values. More specifically, the RTU 102 can be trained, e.g., using training data (e.g., historical or sample data) and a machine learning algorithm, to identify the integrity issue.

At step 218, the RTU 102 performs one or more actions. The one or more actions can be remedial or preventative actions that address the at least one wellbore integrity issue. In one example, the RTU 102 generates a notification for end users (e.g., production engineers) of the at least one wellbore integrity issue. In another example, the RTU 102 generates one or more instructions that can control one or more devices to perform the one or more actions. For instance, the if the RTU 102 detects a potential WH-TCA communication, the one or more actions can include: shutting in the well, scheduling the well with the next available field service crew to pack-off the well, scheduling the well with the next available barge to replace the entire wellhead, scheduling the well with the next available rig to de-complete the well the replace the wellhead, and/or continuing production if certain criteria is met. Packing-off involves injecting a lubricant into rubber seals in order to energize the cells of the seal and block any pressure communication and isolate the different sections of the well.

The RTU 102 then moves to step 220. At step 220, the RTU 102 determines if the workflow 200 has been terminated, e.g., by a production engineer or other end user. If the workflow 200 has not been terminated, the RTU 102 moves back to step 216. Conversely, if the workflow 200 has been terminated, the RTU 102 ceases execution of the workflow 200.

FIG. 3 illustrates an example wellhead 300 of a wellbore, according to some implementations. In particular, FIG. 3 illustrates the location of the pressure gauges that are used to measure wellhead pressure (WHP) and tubing-casing annulus pressure (TCAP).

Figure 4:
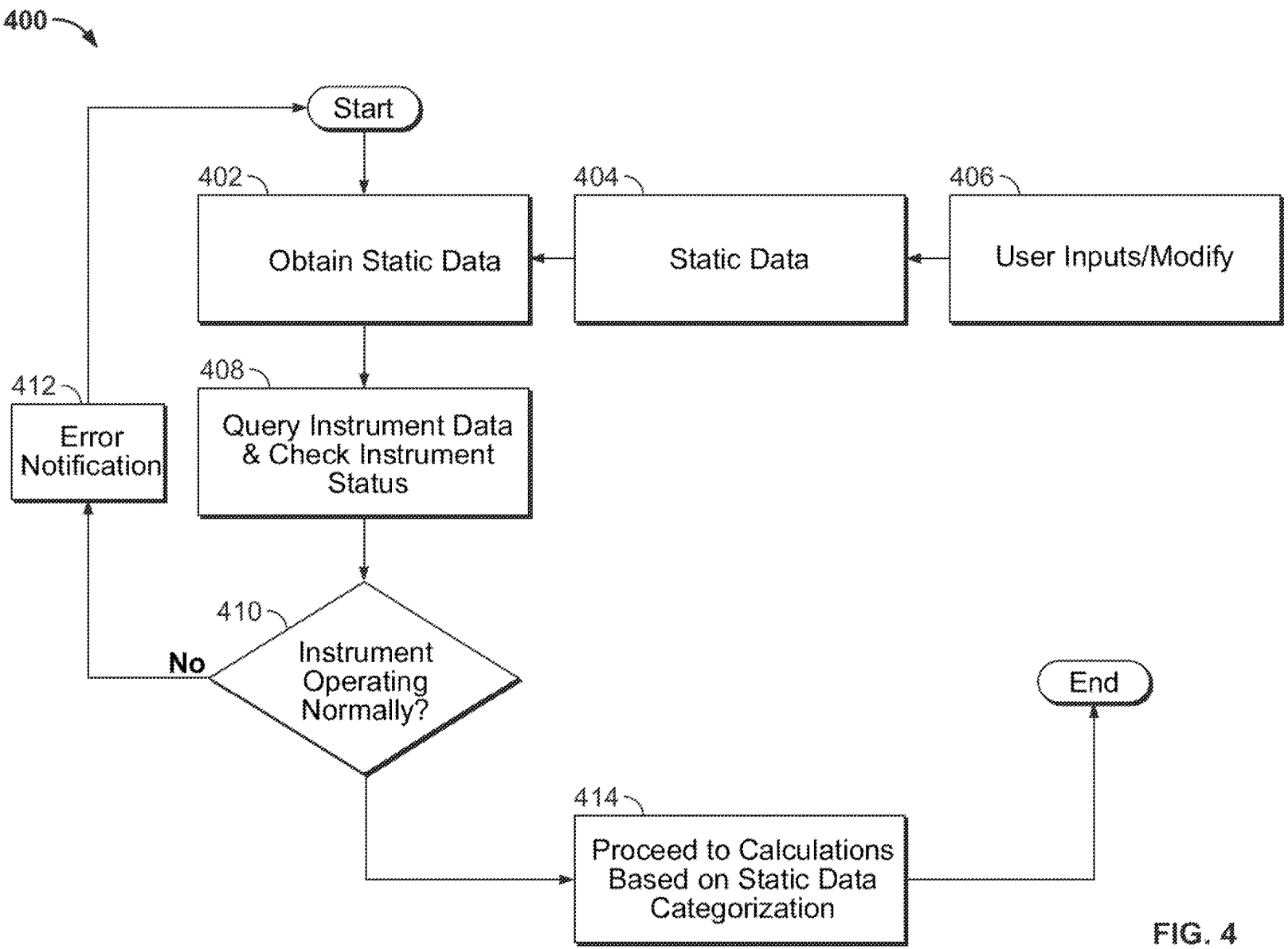
FIG. 4 illustrates an example workflow for checking instrument data, according to some implementations.

FIG. 4 illustrates an example workflow 400 for checking instrument data, according to some implementations. The workflow 400 can be performed by the RTU 102. In particular, the RTU 102 performs the workflow 400 to check instrument data, perhaps periodically or before performing the workflow 200. The workflow 400 enables the RTU 102 to avoid false triggers due to faulty data. Additionally, the workflow 400 allows users to update static data due to changes in the field (e.g., after a rig leaves a production platform and slims down, the tubing of the well or the depth of the packer may change).

At step 402, the RTU 102 obtains static data, which includes, but is not limited to, depth of packer, type of effluent fluid in the annulus, tubing size, wellhead maximum allowable operating pressure (MAOP). The static data includes static data 404, which is the most recently inputted static data that is stored in a database (not shown in FIG. 4). The static data also includes user inputted data 406. The user inputted data 406 can include changes to static data 404 or new data values. A user can change the data for any number of reasons, such as changes in the field or field conditions.

At step 408, the RTU 102 sends a data signal to electronic pressure gauges to retrieve the current data points. The request for the current data points and the data can be exchanged wirelessly or via a wired connection. At step 410, the RTU 102 determines whether the electronic pressure gauges are operating normally. For example, as previously described, the RTU 102 can determine whether the data from the gauges is frozen or out of range. If the data is frozen or out of range, then the RTU 102 can determine that the electronic pressure gauges are not operating normally. In response, the RTU 102 moves to step 412 of generating an error notification. The error notification can be a message displayed on a user device, an audible notification (e.g., alarm sound), or other notification (tactile or haptic feedback on a user device). Conversely, if the RTU 102 determines that the electronic pressure gauges are operating normally, the RTU 102 moves to step 414 of performing calculations based static data categorization. For instance, the RTU 102 can perform the workflow 200 of FIG. 2. After step 414, the workflow 400 ends and can be triggered at a later time.

As stated previously, in some examples, the RTU 102 can calculate a threshold pressure (e.g., for use in the workflow 200). The threshold pressure can be based on surface data, such as flowrate true vertical depth (TVD), and/or static data. For single-phase wells, the flowrate can be measured using an Ultrasonic Flow-Meter (UFM). This is for wells that produce or inject only one fluid (water or gas). For multiphase wells, the flowrate can be measured using Multiphase-Flowmeters or Separators. This is mainly for oil wells that introduce more than one fluid phase into the system. The flowrate can directly influence how much pressure is lost (or gained in the cases for injection and disposal wells) due to wellbore friction. The friction is due to the intra-molecular forces between the fluid being produced and the molecules of the steel making up the tubing pipe. Generally, in production wells, the higher the flowrate the lower the threshold pressure (and vice versa in injection or disposal wells). TVD is used to calculate static or dynamic bottom hole pressure (FBHP). Generally, the deeper the well the higher the FBHP (except for disposal and injection wells). The governing equation for this relationship is:

$$BHP = rho * g * h \tag{1}$$

In Equation (1), "h" is the height of fluid column and "g" is the gravitational effect. In the cases of deep wells (used for oil and gas extraction) "h" is often referred to as TVD. As the above equation indicates, the higher the h (or TVD) the higher the BHP. Rho is the density of the fluid. Therefore, the more dense the fluid the higher the bottomhole pressure.

The static data can include well type (e.g., natural flow producer, Electric Submersible Pump [ESP] producer, water injector, water disposal, gas producer, gas injector), packer setting depth, TCA fluid density, Tubing fluid density, Tubing ID. Tubing OD, Casing ID, Tubing fluid viscosity, and Tubing wall roughness.

In some implementations, the static data can be used to calculate other parameters. For example, a packer setting depth can be used for calculating the FBHP and Static Bottomhole Pressure (SBHP) both within the tubing and within the TCA. These two pressures need to be equal (or close enough to each other, e.g., within 50 psi) in order to ensure a safe wellbore. Any large discrepancies would indicate a potential future packer failure.

Figure 5:
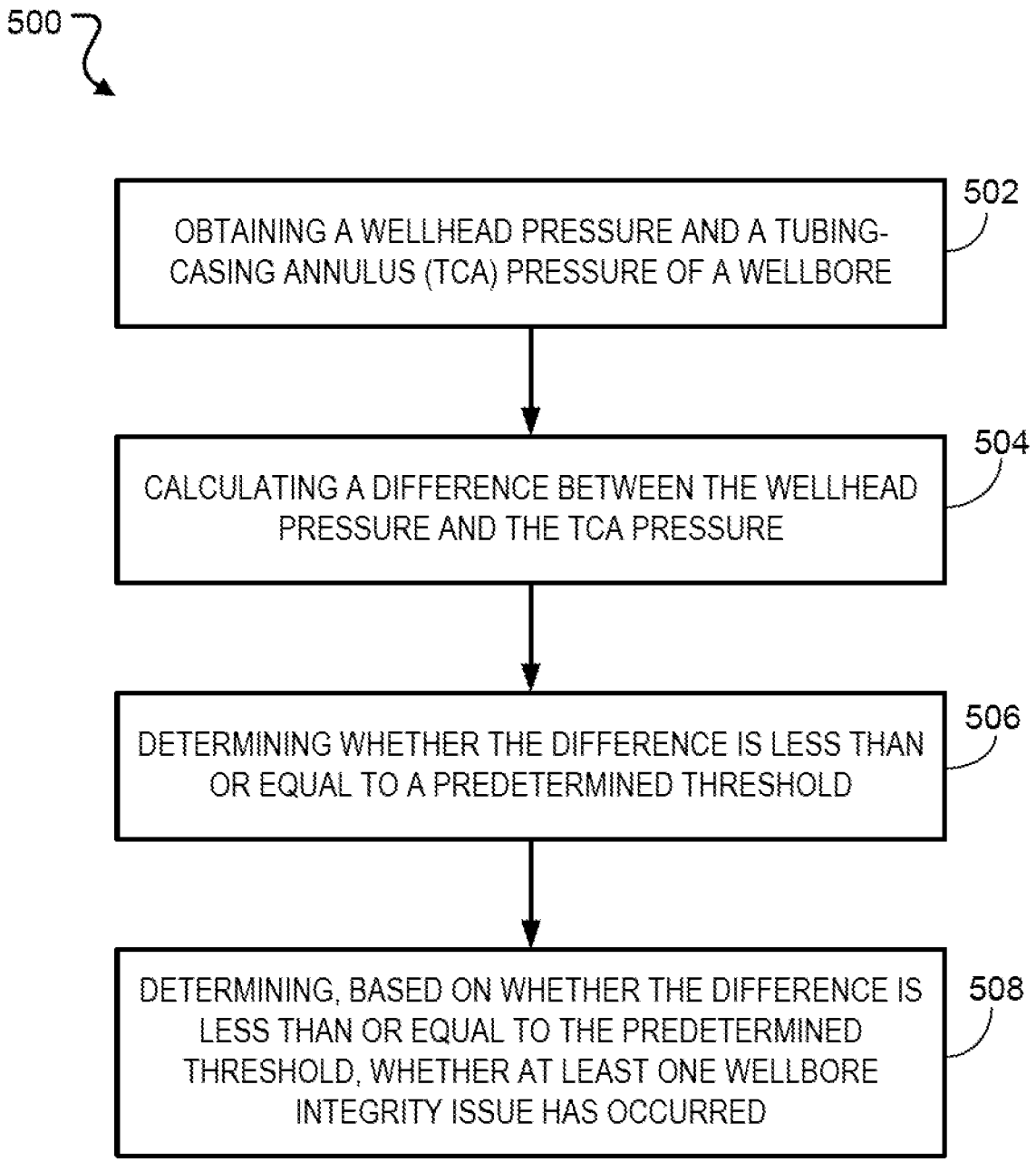
FIG. 5 illustrates a flowchart of an example method, according to some implementations.

FIG. 5 illustrates a flowchart of an example method 500, according to some implementations. For clarity of presentation, the description that follows generally describes method 500 in the context of the other figures in this description. For example, method 500 can be performed by Annulus Monitoring Autonomous Network 100 of FIG. 1. It will be understood that method 500 can be performed, for example, by any suitable system, environment, software, hardware, or a combination of systems, environments, software, and hardware, as appropriate. In some implementations, various steps of method 500 can be run in parallel, in combination, in loops, or in any order.

At step 502, method 500 involves obtaining a wellhead pressure and a tubing-casing annulus (TCA) pressure of a wellbore.

At step 504, method 500 involves calculating a difference between the wellhead pressure and the TCA pressure.

At step 506, method 500 involves determining whether the difference is less than or equal to a predetermined threshold.

At step 508, method 500 involves determining, based on whether the difference is less than or equal to the predetermined threshold, whether at least one wellbore integrity issue has occurred.

In some implementations, determining, based on whether the difference is less than or equal to the predetermined threshold, whether the at least one wellbore has occurred involves: determining that the difference is greater than the predetermined threshold; and in response, determining that the wellbore integrity issue has not occurred.

In some implementations, the method further involves after a predetermined time, obtaining new values of the wellhead pressure and the TCA pressure.

In some implementations, determining, based on whether the difference is less than or equal to the predetermined threshold, whether the at least one wellbore has occurred involves: determining that the difference is less than or equal to the predetermined threshold; and in response, determining that the at least one wellbore integrity issue has occurred.

In some implementations, the method further involves in response determining that the at least one wellbore integrity issue has occurred, performing a remedial action to mitigate the at least one wellbore integrity issue.

In some implementations, the remedial action includes at least one of: shutting in the wellbore; generating an instruction for a computing device to output a notification informing a production engineer of the at least one wellbore integrity issue; scheduling a field service crew to pack-off the wellbore; or scheduling a wellhead replacement for the wellbore.

In some implementations, the predetermined threshold is based on one or more of: deviation of the wellbore, a type of fluid in the TCA, a gas-oil-ratio for a field of the wellbore, the presence of artificial lift mechanisms, a flow regime in the wellbore, a temperature profile throughout the wellbore, or surface level weather conditions.

In some implementations, the predetermined threshold is one third of an average of the wellhead pressure.

In some implementations, the wellbore is a water supply wellbore, a gas injection wellbore, a water injection wellbore, or an oil and gas production wellbore.

In some implementations, the wellhead pressure includes a pressure measured at a point between a choke and a wing valve of the wellbore.

In some implementations, the TCA pressure includes a pressure measured at a port between a tubing and a casing of the wellbore.

FIG. 6 is a block diagram of an example computer system 600 that can be used to provide computational functionalities associated with described algorithms, methods, functions, processes, flows, and procedures, according to some implementations of the present disclosure. In some implementations, the RTU 102 can be the computer system 600, include the computer system 600, or the RTU 102 can communicate with the computer system 600.

The illustrated computer 602 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 602 can include input devices such as keypads, keyboards, and touch screens that can accept user information. Also, the computer 602 can include output devices that can convey information associated with the operation of the computer 602. The information can include digital data, visual data, audio information, or a combination of information. The information can be presented in a graphical user interface (UI) (or GUI). In some implementations, the inputs and outputs include display ports (such as DVI-I+2x display ports), USB 3.0, GbE ports, isolated DI/O, SATA-III (6.0 Gb/s) ports, mPCIe slots, a combination of these, or other ports. In instances of an edge gateway, the computer 602 can include a Smart Embedded Management Agent (SEMA), such as a built-in ADLINK SEMA 2.2, and a video sync technology, such as Quick Sync Video technology supported by ADLINK MSDK+. In some examples, the computer 602 can include the MXE-5400 Series processor-based fanless embedded computer by ADLINK, though the computer 602 can take other forms or include other components.

The computer 602 can serve in a role as a client, a network component, a server, a database, a persistency, or components of a computer system for performing the subject matter described in the present disclosure. The illustrated computer 602 is communicably coupled with a network 630. In some implementations, one or more components of the computer 602 can be configured to operate within different environments, including cloud-computing-based environments, local environments, global environments, and combinations of environments.

At a high level, the computer 602 is an electronic computing device operable to receive, transmit, process, store, and manage data and information associated with the described subject matter. According to some implementations, the computer 602 can also include, or be communicably coupled with, an application server, an email server, a web server, a caching server, a streaming data server, or a combination of servers.

The computer 602 can receive requests over network 630 from a client application (for example, executing on another computer 602). The computer 602 can respond to the received requests by processing the received requests using software applications. Requests can also be sent to the computer 602 from internal users (for example, from a command console), external (or third) parties, automated applications, entities, individuals, systems, and computers.

Each of the components of the computer 602 can communicate using a system bus 603. In some implementations, any or all of the components of the computer 602, including hardware or software components, can interface with each other or the interface 604 (or a combination of both), over the system bus. Interfaces can use an application programming interface (API) 612, a service layer 613, or a combination of the API 612 and service layer 613. The API 612 can include specifications for routines, data structures, and object classes. The API 612 can be either computer-language independent or dependent. The API 612 can refer to a complete interface, a single function, or a set of APIs 612.

The service layer 613 can provide software services to the computer 602 and other components (whether illustrated or not) that are communicably coupled to the computer 602. The functionality of the computer 602 can be accessible for all service consumers using this service layer 613. Software services, such as those provided by the service layer 613, can provide reusable, defined functionalities through a defined interface. For example, the interface can be software written in JAVA, C++, or a language providing data in extensible markup language (XML) format. While illustrated as an integrated component of the computer 602, in alternative implementations, the API 612 or the service layer 613 can be stand-alone components in relation to other components of the computer 602 and other components communicably coupled to the computer 602. Moreover, any or all parts of the API 612 or the service layer 613 can be implemented as child or sub-modules of another software module, enterprise application, or hardware module without departing from the scope of the present disclosure.

The computer 602 can include an interface 604. Although illustrated as a single interface 604 in FIG. 6, two or more interfaces 604 can be used according to particular needs, desires, or particular implementations of the computer 602 and the described functionality. The interface 604 can be used by the computer 602 for communicating with other systems that are connected to the network 630 (whether illustrated or not) in a distributed environment. Generally, the interface 604 can include, or be implemented using, logic encoded in software or hardware (or a combination of software and hardware) operable to communicate with the network 630. More specifically, the interface 604 can include software supporting one or more communication protocols associated with communications. As such, the network 630 or the interface's hardware can be operable to communicate physical signals within and outside of the illustrated computer 602.

The computer 602 includes a processor 605. Although illustrated as a single processor 605 in FIG. 6, two or more processors 605 can be used according to particular needs, desires, or particular implementations of the computer 602 and the described functionality. Generally, the processor 605 can execute instructions and manipulate data to perform the operations of the computer 602, including operations using algorithms, methods, functions, processes, flows, and procedures as described in the present disclosure.

The computer 602 can also include a database 606 that can hold data for the computer 602 and other components connected to the network 630 (whether illustrated or not). For example, database 606 can be an in-memory, conventional, or a database storing data consistent with the present disclosure. In some implementations, the database 606 can be a combination of two or more different database types (for example, hybrid in-memory and conventional databases) according to particular needs, desires, or particular implementations of the computer 602 and the described functionality. Although illustrated as a single database 606 in FIG. 6, two or more databases (of the same, different, or combination of types) can be used according to particular needs, desires, or particular implementations of the computer 602 and the described functionality. While database 606 is illustrated as an internal component of the computer 602, in alternative implementations, database 606 can be external to the computer 602.

The computer 602 also includes a memory 607 that can hold data for the computer 602 or a combination of components connected to the network 630 (whether illustrated or not). Memory 607 can store any data consistent with the present disclosure. In some implementations, memory 607 can be a combination of two or more different types of memory (for example, a combination of semiconductor and magnetic storage) according to particular needs, desires, or particular implementations of the computer 602 and the described functionality. Although illustrated as a single memory 607 in FIG. 6, two or more memories 607 (of the same, different, or combination of types) can be used according to particular needs, desires, or particular implementations of the computer 602 and the described functionality. While memory 607 is illustrated as an internal component of the computer 602, in alternative implementations, memory 607 can be external to the computer 602.

An application 608 can be an algorithmic software engine providing functionality according to particular needs, desires, or particular implementations of the computer 602 and the described functionality. For example, an application 608 can serve as one or more components, modules, or applications 608. Multiple applications 608 can be implemented on the computer 602. Each application 608 can be internal or external to the computer 602.

The computer 602 can also include a power supply 614. The power supply 614 can include a rechargeable or non-rechargeable battery that can be configured to be either user- or non-user-replaceable. In some implementations, the power supply 614 can include power-conversion and management circuits, including recharging, standby, and power management functionalities. In some implementations, the power-supply 614 can include a power plug to allow the computer 602 to be plugged into a wall socket or a power source to, for example, power the computer 602 or recharge a rechargeable battery.

There can be any number of computers 602 associated with, or external to, a computer system including computer 602, with each computer 602 communicating over network 630. Further, the terms "client", "user", and other appropriate terminology can be used interchangeably without departing from the scope of the present disclosure. Moreover, the present disclosure contemplates that many users can use one computer 602 and one user can use multiple computers 602.

Implementations of the subject matter and the functional operations described in this specification can be implemented in digital electronic circuitry, in tangibly embodied computer software or firmware; in computer hardware, including the structures disclosed in this specification and their structural equivalents; or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus", "computer", and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus and special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document; in a single file dedicated to the program in question; or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes; the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks, optical memory devices, and technologies including, for example, digital video disc (DVD), CD ROM, DVD+/−R, DVD-RAM, DVD-ROM, HD-DVD, and BLURAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), or a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations; and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A method comprising:

obtaining, using one or more processors implementing a wellbore monitoring system, a wellhead pressure and a tubing-casing annulus (TCA) pressure of a wellbore;

calculating, using the wellbore monitoring system, a difference between the wellhead pressure and the TCA pressure;

determining, using the wellbore monitoring system, whether the difference is less than or equal to a predetermined threshold, wherein the predetermined threshold is dynamically determined based on real-time wellbore parameters including at least one of: deviation of the wellbore, a type of fluid in the TCA, a gas-oil-ratio for a field of the wellbore, presence of artificial lift mechanisms, a flow regime in the wellbore, a temperature profile throughout the wellbore, or surface level weather conditions;

determining, using the wellbore monitoring system and based on whether the difference is less than or equal to the predetermined threshold, that at least one wellbore integrity issue has occurred; and in response to determining that the at least one wellbore integrity issue has occurred, automatically initiating at least one remedial action by:

generating control signals to shut in the wellbore; or transmitting an electronic notification to a computing device of a production engineer.

2. The method of claim 1, further comprising:

after a predetermined time, obtaining new values of the wellhead pressure and the TCA pressure.

3. The method of claim 1, wherein determining, based on whether the difference is less than or equal to the predetermined threshold, that the at least one wellbore integrity issue has occurred comprises:

determining that the difference is less than or equal to the predetermined threshold.

4. The method of claim 1, wherein the remedial action further comprises at least one of:

scheduling a field service crew to pack-off the wellbore; or scheduling a wellhead replacement for the wellbore.

5. The method of claim 1, wherein the predetermined threshold is one third of an average of the wellhead pressure.

6. The method of claim 1, wherein the wellbore is a water supply wellbore, a gas injection wellbore, a water injection wellbore, or an oil and gas production wellbore.

7. The method of claim 1, wherein wellhead pressure comprises a pressure measured at a point between a choke and a wing valve of the wellbore.

8. The method of claim 1, the TCA pressure comprises a pressure measured at a port between a tubing and a casing of the wellbore.

9. A system comprising:

one or more processors implementing a wellbore monitoring system, the one or more processors configured to perform operations comprising:

obtaining, the wellbore monitoring system, a wellhead pressure and a tubing-casing annulus (TCA) pressure of a wellbore;

calculating, using the wellbore monitoring system, a difference between the wellhead pressure and the TCA pressure;

determining, using the wellbore monitoring system, whether the difference is less than or equal to a predetermined threshold, wherein the predetermined threshold is dynamically determined based on real-time wellbore parameters including at least one of: deviation of the wellbore, a type of fluid in the TCA, a gas-oil-ratio for a field of the wellbore, presence of artificial lift mechanisms, a flow regime in the wellbore, a temperature profile throughout the wellbore, or surface level weather conditions;

determining, using the wellbore monitoring system and based on whether the difference is less than or equal to the predetermined threshold, that at least one wellbore integrity issue has occurred; and in response to determining that the at least one wellbore integrity issue has occurred, automatically initiating at least one remedial action by:

generating control signals to shut in the wellbore; or transmitting an electronic notification to a computing device of a production engineer.

10. The system of claim 9, the operations further comprising:

after a predetermined time, obtaining new values of the wellhead pressure and the TCA pressure.

11. The system of claim 9, wherein determining, based on whether the difference is less than or equal to the predetermined threshold, whether the at least one wellbore integrity issue has occurred comprises:

determining that the difference is less than or equal to the predetermined threshold.

12. The system of claim 9, wherein the remedial action further comprises at least one of:

scheduling a field service crew to pack-off the wellbore; or scheduling a wellhead replacement for the wellbore.

13. The system of claim 9, wherein the predetermined threshold is one third of an average of the wellhead pressure.

14. A non-transitory computer storage medium encoded with instructions that, when executed by one or more computers, cause the one or more computers to perform operations comprising:

obtaining, using one or more processors implementing a wellbore monitoring system, a wellhead pressure and a tubing-casing annulus (TCA) pressure of a wellbore;

calculating, using the wellbore monitoring system, a difference between the wellhead pressure and the TCA pressure;

determining, using the wellbore monitoring system, whether the difference is less than or equal to a predetermined threshold, wherein the predetermined threshold is dynamically determined based on real-time wellbore parameters including at least one of: deviation of the wellbore, a type of fluid in the TCA, a gas-oil-ratio for a field of the wellbore, presence of artificial lift mechanisms, a flow regime in the wellbore, a temperature profile throughout the wellbore, or surface level weather conditions;

determining, using the wellbore monitoring system and based on whether the difference is less than or equal to the predetermined threshold, that at least one wellbore integrity issue has occurred; and in response to determining that the at least one wellbore integrity issue has occurred, automatically initiating at least one remedial action by:

generating control signals to shut in the wellbore; or transmitting an electronic notification to a computing device of a production engineer.

* * * * *